United States Patent [19]

Analetto

[11] 4,026,076

[45] May 31, 1977

[54] PORTABLE STAGE

[76] Inventor: Joseph Analetto, 10 Farragut Ave., Medford, Mass. 02155

[22] Filed: Aug. 25, 1976

[21] Appl. No.: 717,499

[52] U.S. Cl. ..... 52/6; 52/7; 52/65; 52/143; 296/26

[51] Int. Cl.[2] ..... E04H 3/10

[58] Field of Search ..... 52/6, 7, 65, 114, 143; 296/26

[56] References Cited

UNITED STATES PATENTS

| | | | |
|---|---|---|---|
| 2,889,685 | 6/1959 | Pickman | 52/114 X |
| 2,978,754 | 4/1961 | Wilson | 52/7 X |
| 3,181,203 | 5/1965 | Wenger | 52/6 |

*Primary Examiner*—Ernest R. Purser
*Assistant Examiner*—Carl D. Friedman

[57] ABSTRACT

A portable stage has supporting structure extending lengthwise of a trailer dimensioned for highway travel and provided with a central turntable and tracks leading therefrom to both ends of the trailer. Each of a series of joists has a carriage and the turntable is dimensioned to enable all the carriage to be stored thereon side by side. In a first position of the turntable, the joists extend lengthwise of the trailer and in a second position, the joists extend transversely thereof and the carriage is thus positioned to travel along the tracks and be spaced therealong to enable floor members to be detachably attached thereto.

12 Claims, 6 Drawing Figures

10
25
26
27
41A
39
38
42
11
41
40
28
32
12
36
31
25

26
31
10
12
13
32
25
11
29
28
38
42
39
41A
41
40

PORTABLE STAGE

BACKGROUND REFERENCES

U.S. Pat. Nos. 1,238,228, 2,635,889, 2,978,754, 3,181,203, 3,417,518.

BACKGROUND OF THE INVENTION

Because of the practical necessity of providing a platform or stage at various types of outdoor functions, various proposals for portable platforms or stages have resulted.

As far as I am aware, no such proposal has met the demand for a stage or platform of adequate dimensions and strength and capable of quick and easy preparation, for use or for transportation over highways to another site. Each proposal, as far as I am aware, had the limitation that, while the length of structural members that were to extend lengthwise of the stage or platform was limited only by the length of the carrying vehicle which is a variable factor, the length of structural members that were to extend transversely of the stage or platform was limited to the width of the vehicle, a fixed factor, making it necessary that the last named structural members be made up of sections that could be detachably connected or connected by hinges.

THE PRESENT INVENTION

The general objective of the present invention is to provide a portable stage or platform that can be prepared for use or for transportation to another site with maximum ease and convenience while permitting the length of the structural members that are to extend transversely of the carrying vehicle to be limited only by the length thereof, an objective attained with a trailer or other vehicle dimensioned for highway travel, provided with lengthwise structure in support of a centrally located turntable and tracks, desirably double tracks, leading therefrom towards both ends of the vehicle. A series of joists is provided, each of a length greater than the width of the vehicle and each has a carriage designed to travel along said tracks. The turntable is provided with storage means, desirably a track arrangement identical to that leading lengthwise of the trailer, dimensioned to enable all the carriages to be stored thereon. The turntable has first and second positions of use, in the first of which the joists are lengthwise of the vehicle and in the second position, the joists are transversely of the vehicle and the carriage then positioned to engage and travel along the tracks into locations in which floor members may be supported thereby.

Another objective of the invention is to provide a suitable joist construction, an objective attained with each joist including upper and lower beams interconnected by lengthwise bracing and supported by a carriage adapted to travel along the tracks with the joists disposed transversely thereof, the upper beams of the joists connected to the carriages laterally of the lower beams by bracing means and the joists formed with a slight camber such that they do not engage the framework until disposed transversely in desired positions lengthwise thereof and then subjected to an additional load.

BRIEF DESCRIPTION OF THE DRAWINGS

A preferred embodiment of the invention is illustrated by the drawings and

THE PREFERRED EMBODIMENT OF THE INVENTION

Figure 1:
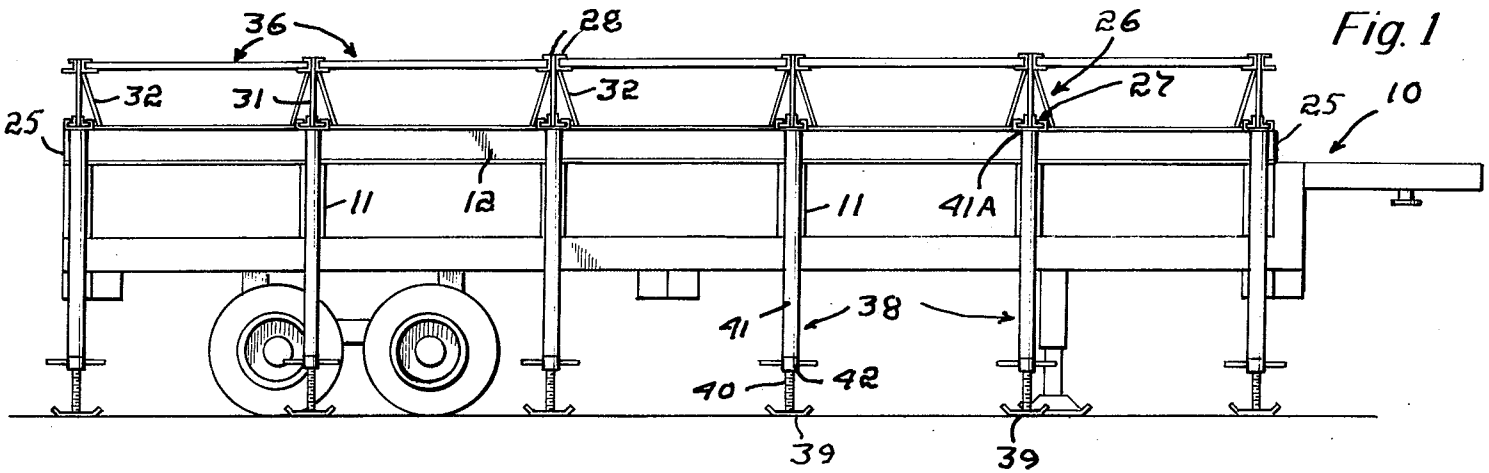
FIG. 1 is a side view of a trailer provided with a stage in accordance with the invention.
Figure 2:
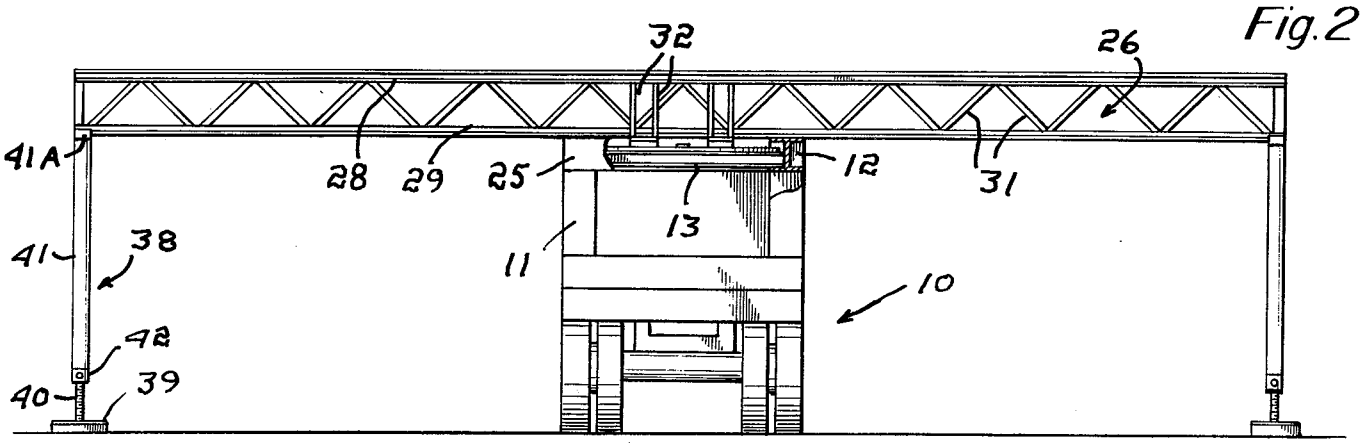
FIG. 2 is a view of the trailer as seen from the rear.
Figure 3:
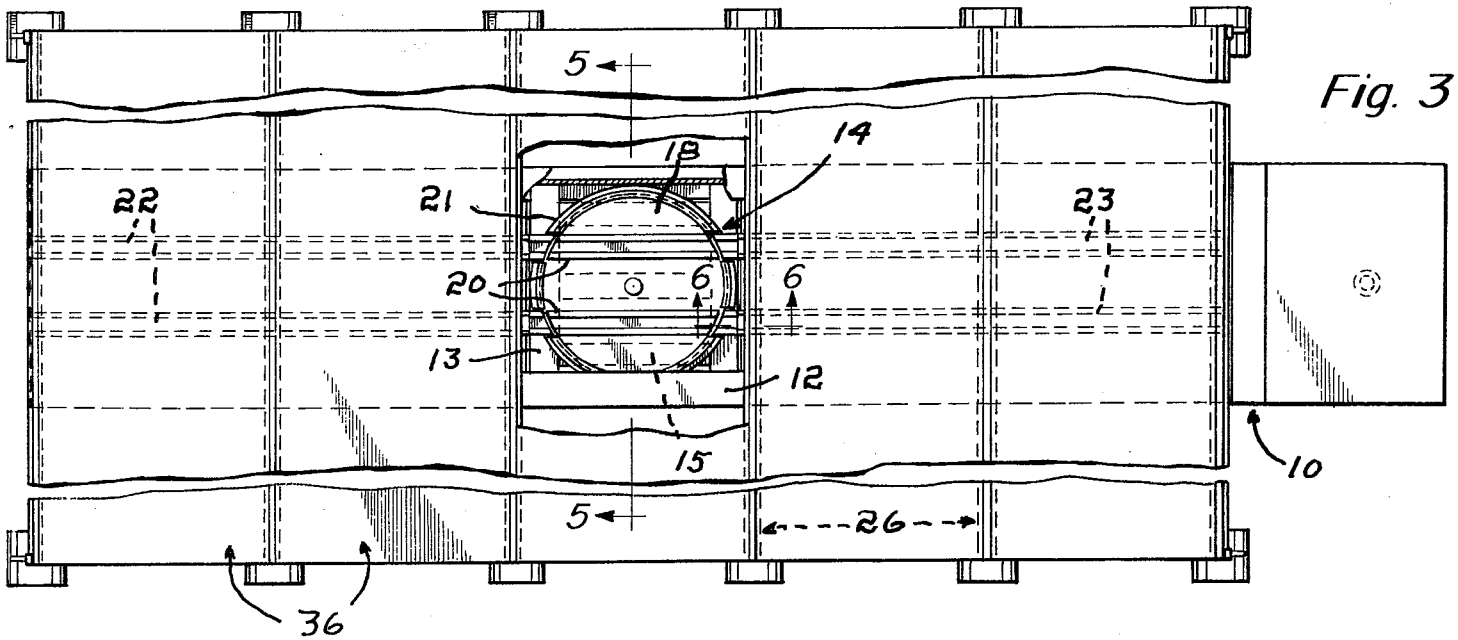
FIG. 3 is a partly sectioned and partly broken away plan view thereof.

A trailer is generally indicated at 10 and is of a type dimensioned and equipped for highway travel. In accordance with the invention, the trailer 10 has a series of uprights 11 spaced along each side with each series in support of an I-beam 12 extending from end-to-end of the trailer. The beams 12 are interconnected by somewhat smaller I-beams 13 resting on their bottom flanges and located above each pair of transversely aligned uprights 11 to complete the supporting framework for a platform or stage of the desired height.

Midway between the ends of the framework, there is a turntable, generally indicated at 14 and the support therefor includes a pair of the beams 13, two beams 15 supported thereby, each close to and parallel to a beam 12 and a central, parallel beam 16 welded to the upper flanges of the beams 13 and shown as U-shaped in cross section.

The turntable 14 includes a base plate 17 resting on the thus established support and a circular plate 18, the plates 17 and 18 connected to the beam 16 by pivot means 19. The plate 18 includes two parallel storage tracks 20, each shown as a relatively wide channel provided with inturned retaining flanges 20A. A circular flange 21 secured to the beams that comprise the support for the turntable plates 17 and 18 serves as a retainer therefor.

A pair of like tracks 22 extend forwardly from the turntable 14 and a like pair of tracks 23 extend rearwardly thereof, the tracks 22 and 23 supported by and secured to beams 13 which are provided with suitably dimensioned shims 24. At each end of supporting framework, beams 25 interconnecting the beams 12 serve as stops at the remote end of the tracks 22 and 23.

Figure 5:
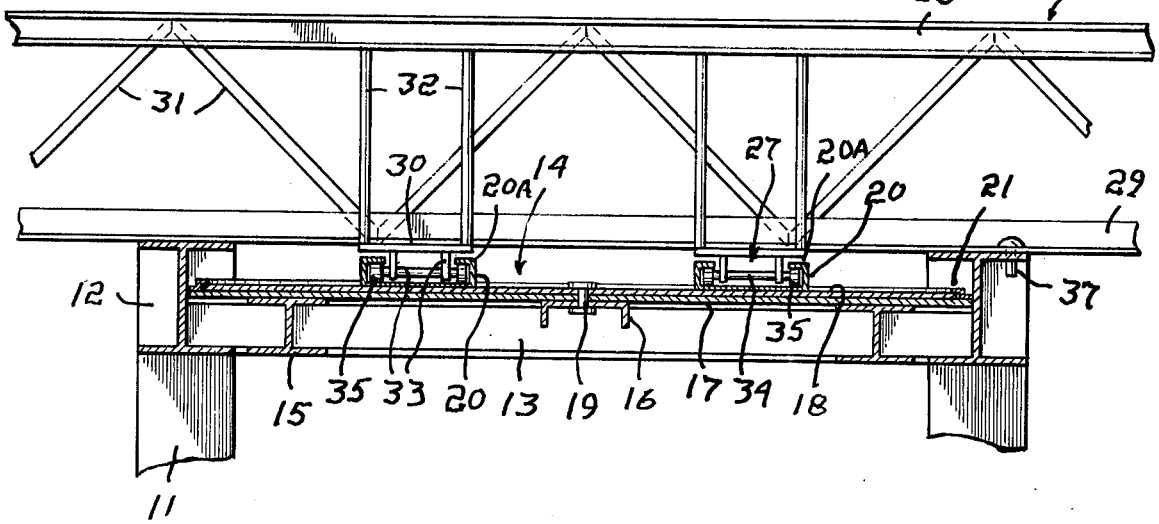
FIG. 5 is a section, on an increase in scale, taken approximately along the indicated line 5—5 of FIG. 3.
Figure 6:
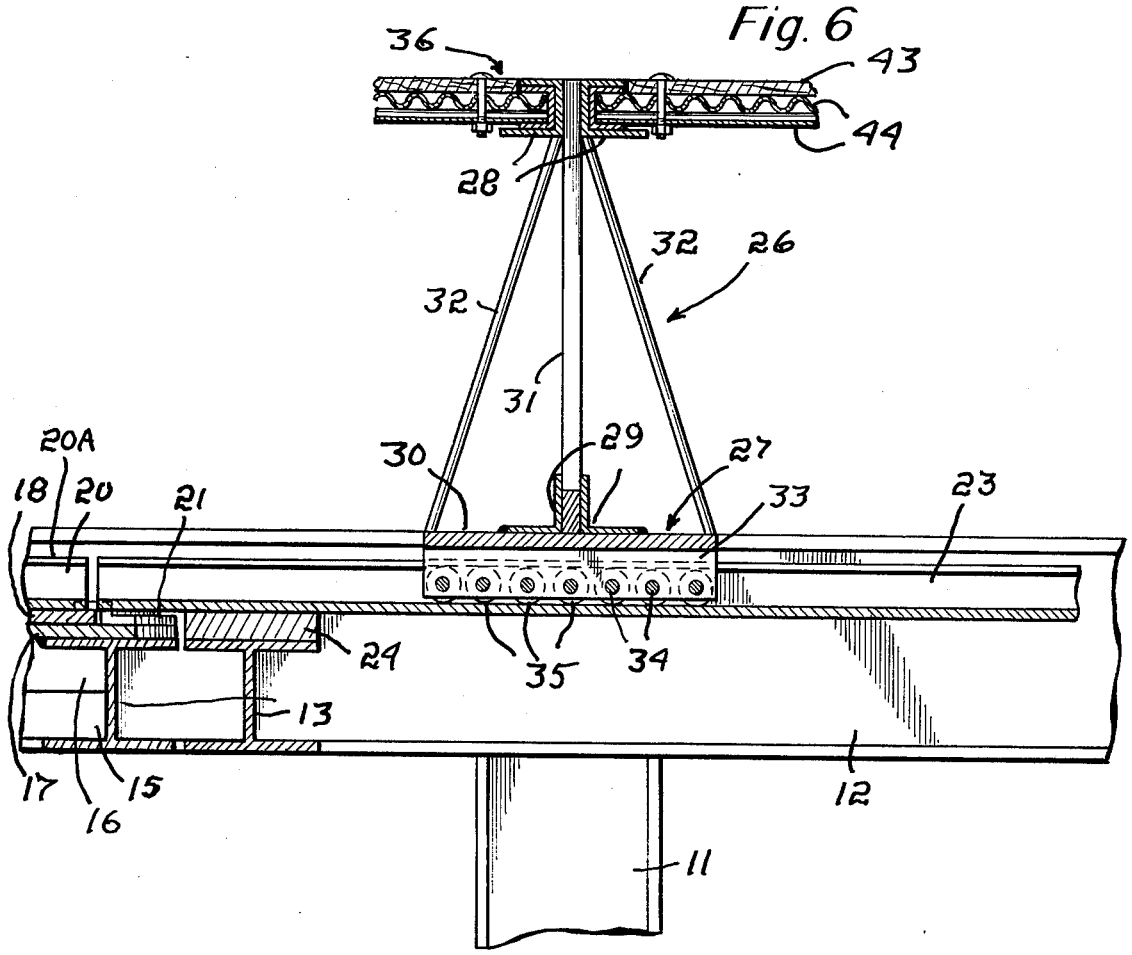
FIG. 6 is a section on a further increase in scale and taken approximately along the indicated line 6—6 of FIG. 3.

A series of joists are provided and each is generally indicated at 26 and including a carriage, generally indicated at 27. One such joist is detailed in FIGS. 5 and 6. Each joist 26 includes a pair of upper beams 28, each of U-shaped section and opening in a direction opposite to the other and a pair of lower beams 29 of right angular section secured to a base 30 transversely of its center. The upper beam 28 and the lower beams 29 are connected together by diagonally disposed braces 31. Struts 32 provide bracing for the joist at right angles to the plane of the joist, the struts 32 extending to the front ends of the base 30. Each joist 26 is formed with a slight camber so that it will not engage the beams 12 until it is in its selected position lengthwise of the trailer and extending transversely thereof and placed under a load.

The base 30 is part of the carriage 27 and is provided with spaced supports 33 supporting a series of shafts 34 provided at their ends with rollers 35 spaced apart and dimensioned to be supported by the tracks 20, 22, and 23 and held therein.

Figure 4:
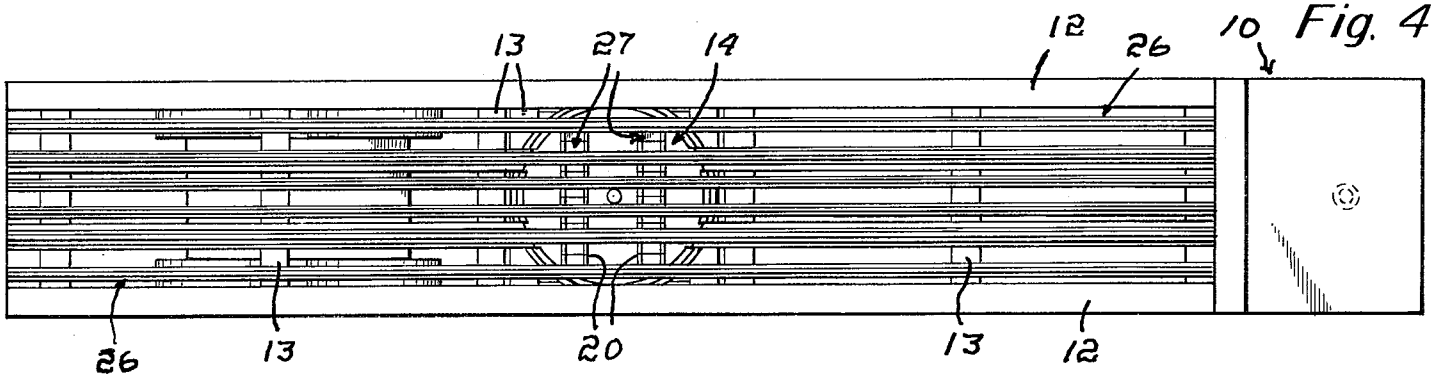
FIG. 4 is another plan view but with the stage collapsed and its joists positioned lengthwise of the trailer.

The joists 26 are shown as coextensive in length with the supporting framework and the carriages 27 are dimensioned so that all may be stored on the turntable as illustrated by FIG. 4. With the joists 26 thus stored and the turntable turned so that the tracks 20 are at right angles to the tracks 22 and 23, the joists are all lengthwise of the trailer 10 and their total width is less than the width thereof.

When, however, the turntable 14 is turned until the stored joists 26 are transversely of the trailer 10, the tracks 20, 22, and 23 are aligned and each joist 26 then may be moved lengthwise of the trailer, some along the tracks 22 towards the front end thereof and some rearwardly along the tracks 23 until the series of joists are spaced predetermined distances apart to enable floor units, generally indicated at 36, to be inserted into the channels of the upper beams 28 of each two proximate joists thus to be supported by the bottom flanges thereof. The camber, as above stated, with which the joists 26 are formed permits them to be turned into either position without contact with the beams 12 but are sufficiently flexible to become seated against them under loads. When each joist 26 is in its floor supporting position, it is locked to a beam 12 as by a lock pin 37, see FIG. 5, extending through a hole in the horizontal wall of a lower beam 29 and a hole in a flange of a beam 12 located to establish the selected joist position.

It will be appreciated that because of the length of the joists 26, it is necessary to provide support at their ends. The supports are generally indicated at 38 and each includes a ground-engaging pad 39 and vertically adjustable sections 40 and 41, the section 40 threaded through the nut 42 by which the section 41 is supported and each section 41 having a holder 41A slidably receiving the bottom flanges of the appropriate joist beam 29. In practice, the supports 38 are stored, when not in use, in the space between the uprights 11 and below the transverse members 13.

The floor units 36 are shown as a laminate including a top, plywood layer 43 and two layers 44 of corrugated aluminum with the corrugations of one disposed at right angles to those of the other and the units 36 are also dimensioned for storage along with the supports 38.

I claim:

1. A transportable stage comprising a vehicle dimensioned for highway travel and provided with framework extending lengthwise thereof, a turntable supported by said framework located between the ends thereof, tracks extending from said turntable towards both ends of the framework and supported thereby, a series of joists of a length greater than the width of the vehicle, each joist including a carriage adapted to travel along said tracks, and said turntable including carriage storage means dimensioned to accommodate all of said carriages side-by-side, said turntable having first and second positions of use in the first of which said joists when on the turntable are lengthwise of the vehicle and in the second of which said joists are transversely thereof, said carriages then positioned for engagement with and movable along said tracks, some forwardly and some rearwardly of said turntable into predetermined positions and floor units supported by said joists.

2. The transportable stage of claim 1 in which the carriage storage means of the turntable is a track arrangement matching the tracks leading to the ends of the framework.

3. The transportable stage of claim 1 in which there are two tracks leading from the turntable towards each end of the framework and the carriage storage means of the turntable is in the form of two tracks spaced and dimensioned for alignment with the framework supported tracks.

4. The transportable stage of claim 3 in which each track includes a pair of channel portions disposed with the channels opening towards each other and each carriage includes a plurality of supporting rollers protruding into the channels.

5. The transportable stage of claim 4 in which each joist includes upper and lower beams and bracing interconnecting said beams, the length of said carriage greater than the width of said joist, and braces mounted on at least one end of said carriage and connected to the upper part of the joist.

6. The transportable stage of claim 5 in which there are two upper beams, each a channel, the channels opening in opposite directions in the same horizontal plane, and the floor units are slidably supported by the proximate channels of a pair of joists.

7. The transportable stage of claim 1 in which each joist includes a pair of channels opening in opposite directions in the same plane and each floor unit is slidably supported by the proximate channels of a pair of joists.

8. The transportable stage of claim 1 and means to lock each joist to each framework when disposed transversely of the framework and in a predetermined position lengthwise thereof.

9. The transportable stage of claim 1 in which each joist has a camber such that it does not engage the framework until disposed transversely thereof and placed under a load.

10. The transportable stage of claim 9 and means to support the ends of a joist when disposed transversely of the framework, each joist including oppositely disposed transverse flanges along its bottom and the supporting means includes a holder slidably receiving said flanges.

11. The transportable stage of claim 7 in which each floor unit includes a surface layer and reinforcement therefor including two corrugated metal sheets, the corrugations of one disposed at right angles to those of the other.

12. The transportable stage of claim 1 in which the turntable includes a bottom plate, a circular top plate, supporting structure for said bottom plate including a beam underlying the center of said top plate, a pivotal connection between said plates and said underlying beam, and a circular retaining flange mounted on said structure and overlying the margin of said top plate.

* * * * *